United States Patent [19]

Aizawa et al.

[11] Patent Number: 4,837,137

[45] Date of Patent: Jun. 6, 1989

[54] ELECTROPHOTOGRAPHIC PHOTORECEPTOR

[75] Inventors: Koichi Aizawa; Toyoki Kazama, both of Yokosuka; Yukio Takano; Yukihisa Tamura, both of Matsumoto, all of Japan

[73] Assignee: Fuji Electric Co., Ltd., Kawasaki, Japan

[21] Appl. No.: 127,921

[22] Filed: Dec. 2, 1987

[30] Foreign Application Priority Data

Dec. 5, 1986 [JP] Japan ..... 61-290678
Jan. 12, 1987 [JP] Japan ..... 62-18974

[51] Int. Cl.[4] ..... G03G 5/082; G03G 5/14

[52] U.S. Cl. ..... 430/65; 430/66; 430/67

[58] Field of Search ..... 430/65, 66, 67

[56] References Cited

U.S. PATENT DOCUMENTS 4,664,999 5/1987 Kakinuma et al. ..... 430/67
4,675,265 6/1987 Kazama et al. ..... 430/67
4,698,288 10/1987 Mort ..... 430/58
4,737,429 4/1988 Mort et al. ..... 430/67 X

FOREIGN PATENT DOCUMENTS

3610076A1 10/1986 Fed. Rep. of Germany ..... 430/66

*Primary Examiner*—Paul R. Michl
*Assistant Examiner*—Jeffrey A. Lindeman
*Attorney, Agent, or Firm*—Brumbaugh, Graves, Donohue & Raymond

[57] ABSTRACT

In the photoreceptor described in the specification, an electroconductive base has an amorphous silicon type photoconductive layer coated over a blocking layer on the base and an amorphous carbon-containing surface layer, coated over a buffer layer on the photoconductive layer, has a hardness on the free surface side which is higher than the hardness on the buffer surface side. Apparatus for preparing the photoreceptor includes a CVD vacuum chamber and an arrangement for supplying selected layer-forming gases to the chamber in a controlled manner.

4 Claims, 1 Drawing Sheet

ELECTROPHOTOGRAPHIC PHOTORECEPTOR

BACKGROUND OF THE INVENTION

The present invention relates to an electrophotographic photoreceptor having a photoconductive layer made of an amorphous silicon series material.

Recently, attention has been paid to amorphous silicon hydride (a-Si(H)) as a photoconductive material for electrophotographic photoreceptors, and the development of such amorphous silicon hydride material is being promoted, since amorphous silicon hydride has excellent light-sensitivity and heat-resistance and has a high hardness. Additionally, a thin film of a-Si(H) having a large area can be obtained relatively easily, and equally important is the fact that this does not cause environmental pollution.

A layer of a-Si(H) is generally formed from a silicon-containing gas, such as silane ($SiH_4$) gas, as a raw material gas by the plasma controlled vapor deposition (CVD) method. The a-Si(H) layer formed by that method has a low localized level in the forbidden band and has a high photoconductivity. In addition, when a sufficient quantity of diborane ($B_2H_6$), phosphine ($PH_3$) or other appropriate gas is incorporated into the raw material gas, electroconductivity control and valence electron control are possible and increased resistance is also possible. Moreover, when an appropriate gas is incorporated into the raw material gas, carbon (C), nitrogen (N), oxygen (0) and the like can be introduced into the resulting a-Si(H) material, so that necessary characteristics, such as charge acceptance, photoconductivity, temperature characteristics, mechanical strength, etc., which are required for the photoreceptor material, can be imparted to the a-Si(H) layer. Accordingly, a photoreceptor having an a-Si(H)-containing light-sensitive layer has extremely desirable properties.

However, although a photoreceptor having a surface layer of such a-Si(H) can produce good images when it is new, it has been known that a photoreceptor of this kind often yields defective images when it is used for image duplication after being exposed to air or to a high moisture atmosphere for a long period of time. In addition, it has also been known that images formed with such a photoreceptor are often of poor quality after the photoreceptor has been used for a large number of repeated duplications. Further, it has been confirmed that degradation of the photoreceptor often causes loss of image quality particularly in a high moisture atmosphere, and the critical humidity level which results in low image quality gradually decreases with an increase in the number of duplications made with the photoreceptor.

As mentioned above, it is believed that in a photoreceptor having a surface layer of a-Si(H) the outermost surface of the photoreceptor is often affected by exposure to air or moisture for a long period of time or by chemical agents (such as ozone, nitrogen oxides, nascent state oxygen, etc.) formed by the corona discharge in the duplication process, whereby defective images are produced as a result of some chemical modification of the photoreceptor. However, the mechanism of such photoreceptor degradation has not yet been ascertained sufficiently.

In order to prevent the generation of such poor quality images and to improve the image quality, durability and the moisture-resistance of the photoreceptor, a means of providing a protective layer on the surface of the photoreceptor for chemical stabilization has been proposed and tried.

For instance, the published unexamined Japanese Patent Application (OPI) No. 115559/82 discloses a method of providing hydrogenated amorphous silicon carbide (a-$Si_xC_{l-x}$(H), $0<x<1$) or hydrogenated amorphous silicon nitride (a-$Si_xN_{l-x}$(H), $0<x<1$) as a surface protective layer so as to prevent the deterioration of the surface layer of the photoreceptor by the duplication process or the environmental atmosphere. However, although the image quality durability can fairly be improved merely by a controlled choice of the carbon concentration or the nitrogen concentration in the surface protective layer, the photoreceptor moisture-resistance cannot be maintained in a high humidity atmosphere (e.g., having a relative humidity of 80% or more), and therefore, the image quality degradation occurs at about 60% relative humidity after the photoreceptor has been used to make several tens of thousands of copies. Thus, in the present situation, image quality durability and the photoreceptor moisture-resistance cannot be improved significantly even by the provision of the surface protective layer of the kind described in this Japanese OPI.

More recently, it has become known that an amorphous carbon (a-C) is extremely effective as a material for such a surface protective layer. However, although the chemical stability and the moisture-resistance of the photoreceptor are greatly improved by the provision of an a-C layer, there still is a problem with the image quality-durability of the photoreceptor, since the mechanical strength of the a-C material used in the protective layer is insufficient to permit a developing agent to be applied to the surface of the photoreceptor for image formation or to resist mechanical loads, such as from a cleaning blade to be applied thereto.

The object of the present invention is to overcome the above-mentioned defects and to provide photoreceptors which have excellent moisture-resistance and image quality durability and are free from deterioration in those characteristics even after storage for a long period of time or after repeated use and are also almost free from deterioration of other characteristics including power decrease or image degradation even after use in a high humidity atmosphere, and which additionally have a surface which is highly resistant to abrasion or damage resulting from the actual image formation process, including development and cleaning.

SUMMARY OF THE INVENTION

In order to attain the said object, the present invention provides an electrophotographic photoreceptor having a photoconductive layer made of an amorphous silicon series material on an electroconductive base wherein the said photoconductive layer is coated with a surface layer made of an amorphous carbon via a buffer layer, and the hardness of the said surface layer on the free surface side is higher than that on the side adjacent to the buffer layer.

By the control of the hardness distribution of the a-C surface layer so that the hardness in the side adjacent to the buffer layer is made smaller than that on the free surface side, the layer part on the side adjacent to the buffer layer may provide a soft backing layer to the hard layer part on the free surface side. Accordingly, the layer part of the surface layer in the side adjacent to the buffer layer has a role as a buffer material in response to the mechanical load to be imparted to the free surface part of the surface layer of the photoreceptor, including the development, cleaning and like processes, during image formation, and thus, mechanical abrasion of the free surface of the surface layer or the surface of the photoreceptor can be prevented and the image quality-durability of the photoreceptor can therefore be noticeably improved.

As the buffer layer, a polysilane-containing film can be used. Although polysilane is a substance represented by a general formula —$(SiH_2)_n$—where Si and H are bonded in a linear state, the polysilane chain may often be partially disrupted such that an alloy state comprising a non-linear random network in Si and H, as seen in amorphous silicon is formed.

When amorphous silicon (a-Si(H)) formed by general glow discharge contains a high concentration H, of 25 wt.% or more, the film quality deteriorates, and this cannot be used in devices such as solar batteries, TFT, photoreceptors, etc. On the other hand, a polysilane containing film can be formed when the hydrogen concentration in the Si-H compound is between 20 and 60 wt.%. Such a polysilane-containing Si-H compound with high hydrogen concentration formed by photo-CVD, homo-CVD or the like special technical means (for example, using silanes of higher order) provides excellent film quality and therefore can be applied to various kinds of electronic devices. The high film quality of such polysilane-containing Si-H compounds can be understood also from the very low number of faults, i.e., about $5\times10^{-7}$ per $cm^3$ as evaluated by electron spin density (ESR) measurements. In addition, this can be proved also from the stronger photoluminescence produced by argon (Ar) laser excitation compared with normal a-Si(H).

BRIEF DESCRIPTION OF THE DRAWINGS

The present invention will be explained in greater detail hereinafter with reference to the accompanying drawings in which.

DESCRIPTION OF PREFERRED EMBODIMENTS

Figure 1:
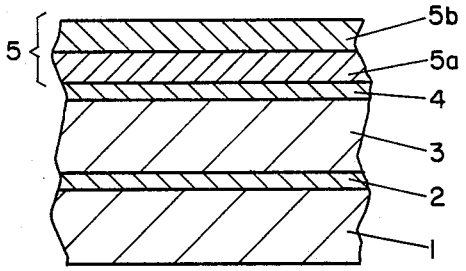
FIG. 1 is a schematic cross-sectional view illustrating the layer arrangement of a representative embodiment of the photoreceptor of the present invention.

The representative photoreceptor shown in FIG. 1 includes an electroconductive base 1 which can have a cylindrical, tabular or sheet form, and it can be made of a metal, such as an aluminum or stainless steel, or of a glass or resin whose surface has been treated to provide electroconductivity.

A blocking layer 2 is provided on the surface of the base so as to block the injection of electric charge from the electroconductive base 1 into the photoconductive layer. The blocking layer can be made of $Al_2O_3$, AlN, SiO, $SiO_2$, hydrogenated and fluorinated amorphous silicon carbide (a-$Si_{l-x}C_x$(F,H)), hydrogenated amorphous silicon nitride (a-$SiN_x$(H)), hydrogenated amorphous carbon (a-C(H)), fluorinated amorphous carbon (a-C(F)), as well as a-C(H), a-C(F), or a-Si(H) which is doped with an element of Group III or Group V of the Periodic Table. The blocking layer is preferably thin, such as 1m or less.

A photoconductive layer 3 is coated on the layer 2. The layer 3 is preferably made of a material which has a high absorption of the image exposing light and, additionally, has a high photoconductivity. For example, the material of the layer 3 is preferably a-Si(H), a-Si(F,H), a-$Si_{l-x}C_x$(H) ($0<x<0.3$), a-$SiN_x$(H) ($0<x<0.2$), a-$SiO_x$(H) ($0<x<0.1$), a-$Si_{l-x}Ge_x$(H) or the like, or one of those materials which has been doped with an element of Group III or Group V of the Periodic Table. The film thickness of the layer 3 is preferably from about 3 μm to about 60 μm for practical applications.

In order to buffer the difference between the materials of a layer which is nearer to the base, for example, the photoconductive layer 3 and a surface layer 5, a buffer layer 4 is provided. For the buffer layer, materials such as a-C(H), a-C(H,F), a-$Si_{l-x}C_x$(H) ($0<x<1$), a-$Si_{l-x}C_x$(F,H) ($0<x<1$), a-$SiN_x$(H) ($0<x<4/3$), a-$SiO_x$(H) ($0<x<2$), a-$SiO_x$(F,H) ($0<x<2$) and the like can be used. The film thickness of the buffer layer 4 is determined in accordance with the spectral sensitivity, residual potential and electric conformity with the adjacent layers, and is desirably about 1 μm or less.

The surface layer 5 is made of a hydrogencontaining amorphous carbon (a-C(H)), and it does not produce any definite crystal diffraction image by X-ray or electron diffraction. Even though this layer may contain some crystalline carbon, the ratio of the crystalline part to the remainder is small. The hydrogen in the a-C(H) surface layer is bonded to the free bond of the carbon atom, thereby stabilizing the layer.

In the photoreceptor of the present invention, the surface layer 5 is further divided into a layer 5*a* which is on the buffer layer side and a layer 5*b* which is on the free surface side, and the hardness of the layer 5*a* is controlled so as to be lower than that of the layer 5*b*.

The surface layer 5 is formed by decomposing a hydrocarbon gas containing C and H, for example, by a glow discharge decomposition method, to form the a-C(H) film, and the a-C(H) film may have hardness variations in accordance with the film-forming conditions. In general, when the flow rate of the raw material gas is large or when the gas pressure is high, the film formed is soft. Further, when the base temperature during film formation is high, the film formed is also soft. Accordingly, the hardness of the layer 5*a* can be made lower than that of the layer 5*b* by controlling the flow rate of the raw material gas so that it is higher during the formation of the layer 5*a* on the free surface side than during the formation of the layer 5*b* on the buffer layer, or by making the gas pressure or the base temperature higher during the formation of the layer 5*a* than during the formation of the layer 5*b*.

Because the surface layer 5 has such differing characteristics from one side to the other, the layer 5*a* can constitute a buffer material for the load imparted to the surface of the photoreceptor or the surface of the layer 5*b* during actual image formation under electric power. As a result, the load applied to the surface of the layer 5*b* can be reduced by the function of the layer 5*a* as a cushion material and thus the image reproduction durability of the photoreceptor can be greatly improved.

The hydrogen concentration in the layer 5*b* on the free surface side of the layer 5 generally falls within the range of about 1 to 60 wt.%, and the specific concentration depends upon the filming conditions including the raw material gas, gas flow rate, gas pressure, discharge power, base temperature, etc. The preferred range is from about 10 to about 40 wt.%. In addition, it is preferred that layer 5 have an energy gap (Eg) from about 2.2 eV to 3.2 eV, a refractive index from about 1.5 to 2.6, a specific resistance from about $10^8$ to $10^{15}$ohm-cm, and that the density is about 1.3 g/cm$^3$ or more.

In accordance with the discovery by the present inventors, it has been proved that the bonding state between the hydrogen atom and the carbon atom contained in the a-C(H) layer 5 is reflective of the bonding state of the carbon atoms therein, and therefore, the H-C bonding state is important and is one of significant factors for determining the applicability of the a-C(H) layer to the surface layer of an electrophotographic photoreceptor. As the bonding state of carbon atoms, there may be mentioned a diamond bond (four-coordination), a graphite bond (three-coordination), etc. It is known that an a-C(H) film consisting mainly of a graphite bond or a polymeric bond $(—CH_2—)_n$ comprising carbon and hydrogen is poor in chemical-resistance and also in mechanical strength, while on the other hand, it is also known that an a-C(H) film consisting mainly of a diamond bond is excellent in chemical-resistance and mechanical strength.

In view of this point, the present inventors studied the infrared absorption spectrum of a-C(H) films and the chemical-resistance and mechanical strength thereof, and as a result, have found that in an a-C(H) surface layer, the value of the ratio $(\alpha_2/\alpha_1)$ of the absorptive index $(\alpha_2)$ at the infrared absorption spectrum line 2960 cm$^{-1}$ to the absorptive index $(\alpha_1)$ at the spectrum line 2920 cm$^{-1}$ is preferably 0.8 or more in order that the a-C(H) surface layer can sufficiently function as the surface protective layer of an electrophotographic photoreceptor.

As a means for stabilizing the free bonds in the amorphous carbon, not only hydrogen but also fluorine, oxygen or nitrogen can be used.

Figure 2:
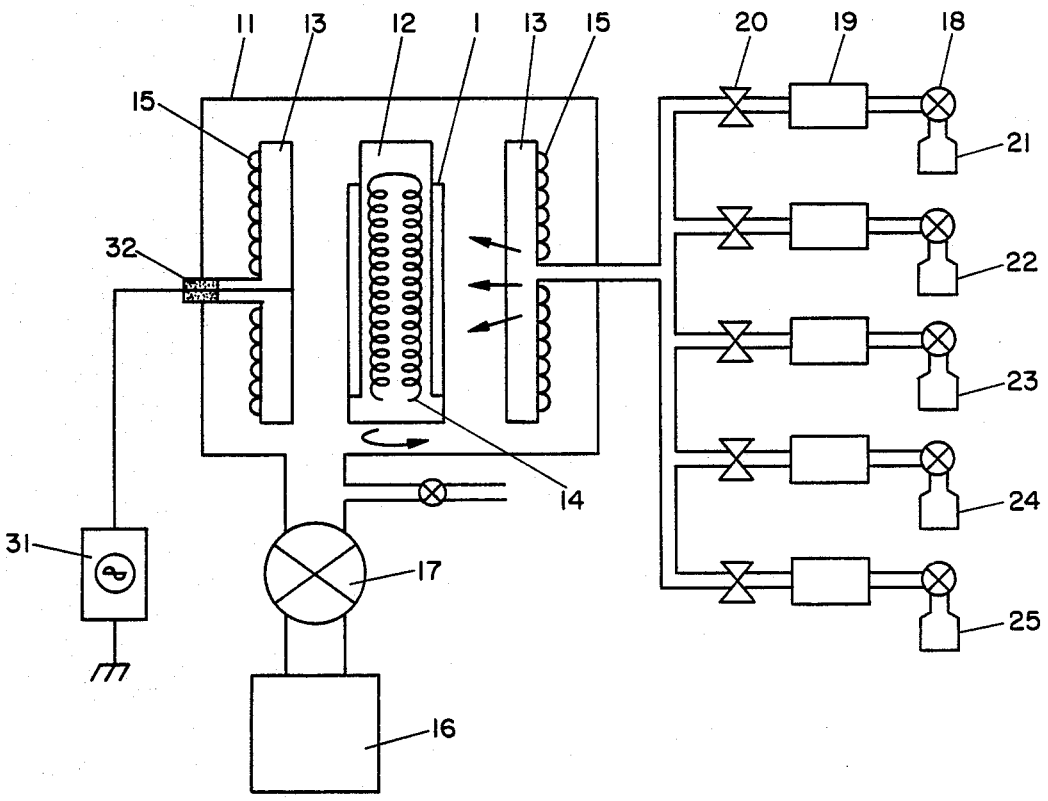
FIG. 2 is a schematic diagram illustrating a typical apparatus for use in the manufacture of a photoreceptor according to the present invention.

For the manufacture of a photoreceptor having the structure shown in FIG. 1, for example, an apparatus of the type illustrated in FIG. 2 may be used for the formation of an amorphous film. In the representative apparatus shown in FIG. 2, a base holder 12 for the base 1 of the photoreceptor and two opposed electrodes 13 are provided inside a vacuum chamber 11, and the holder and the electrodes are provided with heaters 14 and 15, respectively. An aluminum alloy cylindrical base 1 which has been degreased and washed with trichloroethylene is fixed to the holder 12, and the pressure in the vacuum chamber 11 is reduced to $10^{-6}$ Torr by an exhaust pump 16 through an exhaust valve 17. The base 1 and the electrodes 13 are heated to a selected temperature by the heater 14 and the heaters 15. The holder 12 and the base 1 are rotated so as to make the film formed on the surface of the base uniform in the peripheral direction.

Five gas containers 21 to 25, containing various raw material gases under pressure, are connected through corresponding valves 18, flow controllers 19 and check valves 20 to the vacuum chamber 11. To form the photoreceptor, the valve of the pressure container containing the gas necessary for the formation of the first desired layer, for example, the valve 17 of the container 21, is opened so that the gas in the container 21 may be passed through the gas flow controller 19 and the check valve 20 into the vacuum chamber 11 to form the first layer on the base 1.

Next, after the pressure in the chamber is adjusted to a determined pressure, for example, falling within the range of from 0.001 to 5 Torr, a high frequency (13.56 MHz) power is imparted from a high frequency (RF) source 31 to the electrode 13 through a bushing 32, whereby the film formation is carried out by glow discharge between the electrode 13 and the base 1. The same procedure is followed with respect to the gases in the other containers 22–25 as necessary to form additional layers on the base 1 providing the desired photoreceptor structure.

Concrete examples are set forth hereinafter.

EXAMPLE 1

An aluminum alloy cylindrical base 1, which had been degreased and washed with trichloroethylene, was set in the holder 12 in the vacuum chamber 11 of the apparatus of FIG. 2, and a blocking layer 2 having 0.2 μm thickness was formed under the following conditions:

$SiH_4$ (100%) Flow rate 250 cc/min
$B_2H_6$ (5000 ppm, $H_2$ base) Flow rate 20 cc/min
Gas Pressure 0.5 Torr
RF Power 50 W
Base Temperature 200°
Filming Time 10 min Next, a photoconductive layer 3 having a 27 μm thickness was formed over the blocking layer under the following conditions:

$SiH_4$ (100%) Flow rate 200 cc/min
$B_2H_6$ (20 ppm, $H_2$ base) Flow rate 10 cc/min
Gas Pressure 1.2 Torr
RF Power 300 W
Base Temperature 200° C.
Filming Time 3 hr.

Next, a buffer layer 4 having a 0.1 μm thickness was formed over the photoconductive layer under the following conditions:

$SiH_4$ (100%) Flow rate 100 cc/min
$CH_4$ (100%) Flow rate 80 cc/min
$B_2H_6$ (2000 ppm, $H_2$ base) Flow rate 15 cc/min
Gas Pressure 1.0 Torr
RF Power 200 W
Base Temperature 200° C.
Filming Time 2 min Next, a composite layer 5 with 0.2 μm thickness having a layer **5*a* on the buffer layer side and a layer 5*b* on the free surface side was formed over the buffer layer 4** under the following conditions:

| | Layer (5a) on the buffer layer side | Layer (5b) on the free surface side |
|---|---|---|
| $C_3H_8$ (100%) Flow rate | 20 cc/min | 10 cc/min |
| Gas Pressure | 0.05 Torr | 0.03 Torr |
| RF Power | 200 W | 200 W |
| Base Temperature | 100° C. | 100° C. |
| Filming Time | 5 min | 15 min |

In the photoreceptor thus formed, the energy gap (Eg) of the photoconductive layer 3 was 1.8 eV, the composition of the buffer layer 4 was a-$Si_{0.7}C_{0.3}$(H) and the Eg of the layer 4 was 2.1 eV. In the surface layer 5, the layer **5*a* on the buffer layer side had an Eg of 2.4 eV and a hardness of 400 kg/mm$^2$, and the layer 5*b*** on the free surface side had an Eg of 2.7 eV and a hardness of 1000 kg/mm$^2$. The hardness was measured with an ultramicro-hardness tester DUH-50 (manufactured by Shimazu Seisakusho Ltd., Japan) under a load of 0.05 g.

The photoreceptor of the present example was installed in a Carlson-type plain paper copier using a cleaning blade and 50,000 copies were made. Neither the characteristic deterioration of the photoreceptor nor surface abrasion thereof were detected and extremely sharp images were obtained in every copy. In addition, no image deterioration was detected even when copying in an atmosphere having a temperature of 35° C. and a relative humidity of 85%.

COMPARATIVE EXAMPLE 1

For comparison, the process of the above-mentioned Example 1 was repeated under the same procedures and conditions, except that the surface layer 5 did not have the layer **5*b*** on the free surface side, and a comparative photoreceptor was formed. This was subjected to the same copy test involving reproduction of 50,000 copies. Although good images were obtained and no problem occurred with the images formed in the copying procedure carried out under the high moisture condition of temperature 35° C. and relative humidity 85%, the surface of the photoreceptor had some scratches, which would be caused by the developing agent, and additionally was abraded, which would be caused by the developing agent, and additionally was abraded, which would be caused by the cleaning blade. Under the same conditions, the duplication was further continued, and after the formation of 100,000 copies, the abrasion became severe enough to cause image degradation.

COMPARATIVE EXAMPLE 2

For another comparison, the process of the above-mentioned Example 1 was repeated under the same procedures and conditions, except that the surface layer 5 did not have the layer **5*a*** on the buffer layer side, and another comparative photoreceptor was formed. This was subjected to the same copy test involving reproduction of 50,000 copies. In this case, the surface layer was slightly abraded although the abrasion was not as severe as in the case of the

COMPARATIVE EXAMPLE 1

As is apparent from the above, the image quality durability of the photoreceptor can be improved by the provision of the layers formed as described in Example 1. The reason is believed to be as follows: In the a-C(H) film constituting the surface layer 5 in the photoreceptor of the Example 1, both the layer **5*a* on the buffer layer side and the layer 5*b* on the free surface side have a hardness which should normally be abraded by the load caused by the developing agent or the cleaning blade during the image formation, as noted from the results of the Comparative Examples 1 and 2, although the degree of the abrasion would somewhat differ in each case. However, in the layer arrangement of Example 1 where the layer 5*b* having a higher hardness on the free surface side is laminated on the layer 5*a*** having a lower hardness on the buffer layer side, the soft subbing layer acts as a buffer material, which can absorb the load applied by the developing agent or the cleaning blade and, therefore, the surface of the photoreceptor is hardly abraded by the said load.

COMPARATIVE EXAMPLE 3

The process of Example 1 was repeated up to the formation of the buffer layer 4. Next, the surface layer 5 comprising the layer **5*a* on the buffer layer side and the layer 5*b* on the free surface side was formed by varying the filming conditions of these two layers so as to vary the respective hardness of each layer part. The hardnesses of the two layer parts in each instance is shown in the following Table 1. The photoreceptors thus formed were subjected to the same copy test for reproduction of 50,000 copies, and the state of the abrasion of the surface of each photoreceptor was observed. The results are shown in the Table 1. In these photoreceptors, the thickness of each of the two layer parts 5*a* and 5*b*** was 0.1 μm, individually. In Table 1, the unit of hardness is kg/mm².

TABLE 1

Surface Abrasion After 50,000 Copy Run

| | | Hardness of Surface Layer-Free Surface Side (Kg/mm²) | | | | | |
|---|---|---|---|---|---|---|---|
| | | 300 | 500 | 700 | 1000 | 1500 | 2000 |
| Hardness of Surface Layer-Buffer Layer Side (Kg/mm²) | 300 | X | Δ | O | O | O | O |
| | 500 | X | Δ | O | O | O | O |
| | 700 | X | Δ | Δ | O | O | O |
| | 1000 | X | Δ | Δ | Δ | O | O |
| | 1500 | X | Δ | Δ | Δ | O | O |

In the above Table 1, "O" means no abrasion, "Δ" means slight abrasion, and "X" means noticeable abrasion. The degree of the abrasion was determined by visual observation.

From the results of the Table 1, it is noted that the surface of the photoreceptor was not abraded when the hardness of the layer on the free surface side was higher than that of the subbing layer on the buffer layer side, even though the hardness value was relatively small such as 700 kg/mm², and therefore the photoreceptor had excellent printing-durability and the effect of the present invention was remarkable. In particular, the hardness of the layer in the free surface side is more preferably 1500 kg/mm² or more.

EXAMPLE 2

The process of the Example 1 was repeated under the same conditions for the formation of the blocking layer, the photoconductive layer and the surface layer. For the formation of the buffer layer, the base temperature was lowered to 80° C. after the formation of the photoconductive layer, and raw material gases of $Si_2H_6$ (disilane) and $B_2H_6$ were introduced into the chamber to form a buffer layer having a 0.1 μm thickness under the following conditions:

$Si_2H_6$ (100%) Flow rate 100 cc/min
$B_2H_6$ (2000 ppm, $H_2$ base) Flow rate 5 cc/min
Gas Pressure 0.5 Torr
RF Power 30 W
Base Temperature 110° C.
Filming Time 1 min.

The energy gap of the buffer layer was 2.1 eV, and the hydrogen concentration thereof was 32 wt.%. From the analysis of the vibration mode of Si-H and Si-$H_2$ near 2000 $cm^{-1}$ in the infrared absorption spectrum, it was confirmed that 60% or more of the total hydrogen amount was bonded to form Si-$H_2$ bonds.

The photoreceptor thus manufactured was installed in a Carlson-type plain paper copier and subjected to repeated copying in an atmosphere of 35° C. and relative humidity 85%, and extremely sharp images were obtained.

Although the surface layer 5 comprises two layers **5*a* and 5*b*** in the above-mentioned Examples 1 and 2 and Comparative Example 3, a two-layer construction is not always indispensable for the surface layer. Instead, the surface layer may comprise three or more laminate layers provided that the layer arrangement is planned so that a layer having a lower hardness than the layer on the free surface side exists between the free surface side and the buffer layer. In the formation of such layers, however, attention should be paid so that the energy gap does not rapidly vary in the surface layer arrangement. In addition, if the buffer layer is made of a-C(H), it is possible that the buffer layer can function as the backing layer to be provided on the buffer layer side so that the photoreceptor may have one less layer in the laminate layer structure.

Although the hardness of the a-C(H) film in the surface layer was varied by changing the filming conditions in the above Examples, the hardness of the film to be formed can of course be varied also by changing the kind of raw material gases used.

Thus, in accordance with the present invention a photoreceptor is provided which has a photoconductive layer made of an a-Si series material on an electroconductive support, and the photoconductive layer is coated, via a buffer layer, with a surface layer made of a-C(H), the hardness of which is lower on the side adjacent to the buffer layer than on the free surface side.

Because of the arrangement of the surface layer, the low hardness part of the surface layer on the buffer layer side can act as a buffer to the load of the developing agent or cleaning blade which is imparted to the high hardness free surface side. As a result, abrasion of the free surface side of the surface layer, as well as the surface of the photoreceptor, can be prevented and the image quality-durability of the photoreceptor is remarkably improved. Accordingly, the electrophotographic photoreceptor obtained by the present invention provides substantial improvements in that the surface of the photoreceptor is hardly abraded during the actual formation process under electric power, including development and cleaning, the image quality-durability and the moisture-resistance are high, the characteristics are not deteriorated even after storage for a long period of time or after repeated use, and image degradation hardly occurs in duplication under electric power even in a high moisture atmosphere.

Although the invention has been described herein with reference to specific embodiments, many modifications and variations therein will readily occur to those skilled in the art. Accordingly, all such variations and modifications are included within the intended scope of the invention.

We claim:

1. An electrophotographic photoreceptor comprising an electroconductive base, a photoconductive layer comprising amorphous silicon over the base, a buffer layer over the photoconductive layer, and a surface layer comprising amorphous carbon over the buffer layer, the surface layer having a hardness on the free surface side which is higher than that on the buffer layer side.

2. An electrophotographic photoreceptor as claimed in claim 1 wherein the hardness of the surface layer on the free surface side is at least about 1500 kg/mm$^2$.

3. An electrophotographic photoreceptor as claimed in claim 1 wherein the buffer transition layer comprises polysilane.

4. An electrophotographic photoreceptor according in claim 1, wherein the hardness of the surface layer on the free surface side is from 700 to 1500 Kg/mm$^2$.

* * * * *

UNITED STATES PATENT AND TRADEMARK OFFICE

CERTIFICATE OF CORRECTION

PATENT NO. : 4,837,137

DATED : June 6, 1989

INVENTOR(S) : Aizawa et al.

It is certified that error appears in the above-identified patent and that said Letters Patent is hereby corrected as shown below:

First page, last line of Item 30, "Jan. 12" should read --Jan. 29--;

Column 3, line 14, "in Si" should read --of Si-;

Column 3, line 68, "lm" should read --1μm--;

Column 6, line 24, "27" should read --25--;

Column 7, line 40, "COMPARATIVE EXAMPLE 1" should read --Comparative Example 1.--.

Signed and Sealed this

Twenty-fourth Day of April, 1990

*Attest:*

HARRY F. MANBECK, JR.

*Attesting Officer*

*Commissioner of Patents and Trademarks*